US005241890A

United States Patent [19]

Galper

[11] Patent Number: 5,241,890

[45] Date of Patent: Sep. 7, 1993

[54] SPEAKER VENT

[76] Inventor: Avraham Galper, 679 Coldstream Avenue, Toronto, Ontario, Canada, M6B 2L6

[21] Appl. No.: 751,997

[22] Filed: Aug. 29, 1991

Related U.S. Application Data

[63] Continuation-in-part of PCT/CA91/00136, filed May 23, 1991.

[30] Foreign Application Priority Data

Jul. 3, 1990 [GB] United Kingdom ..... 9014727

[51] Int. Cl.[5] ..... G10D 9/00

[52] U.S. Cl. ..... 84/380 R; 84/382; 84/384; 84/388; 84/386

[58] Field of Search ..... 84/380 R, 382, 384, 84/385 R, 388, 386

[56] References Cited

U.S. PATENT DOCUMENTS

| | | | |
|---|---|---|---|
| 1,504,387 | 8/1924 | Shane | 84/385 R |
| 2,020,261 | 11/1935 | Loney | 84/385 |
| 2,226,536 | 12/1940 | Selmer | 84/382 |
| 2,232,929 | 2/1941 | Selmer | 84/385 R |
| 2,508,550 | 5/1950 | Stubbins | 84/382 |
| 2,951,414 | 9/1960 | Christensen | 84/382 |
| 3,844,193 | 10/1974 | Marchi | 84/382 |
| 4,714,001 | 12/1987 | Kergomard et al. | 84/380 R |

FOREIGN PATENT DOCUMENTS 8903448 6/1989 Fed. Rep. of Germany .

*Primary Examiner*—Michael L. Gellner
*Assistant Examiner*—Eddie C. Lee
*Attorney, Agent, or Firm*—Sim & McBurney

[57] ABSTRACT

In a woodwind instrument, the improvement comprising a speaker vent extending from inside to outside of the instrument, said speaker vent being characterized by an internal volume in the range of 200 $mm^3$ to 285 $mm^3$.

7 Claims, 4 Drawing Sheets

SPEAKER VENT

CROSS REFERENCE TO RELATED APPLICATION

This is a continuation-in-part application of International Patent Application No, PCT/CA91/00136 filed on Apr. 23, 1991 (pending).

FIELD OF THE INVENTION

This invention relates in general to woodwind instruments, and more particularly to an improved clarinet speaker vent for providing a better "throat" B♭.

BACKGROUND OF THE INVENTION

The speaker vent is a small tube in a clarinet that assists the player in changing from the low register to the next higher register. More particularly, the vent serves the function of breaking the vibrating column of air within the bore of the clarinet into further acoustical segments.

The small speaker vent also acts as a musical note called "throat" tone B♭. In existing clarinets, the sound of this note is weak and fuzzy. Many attempts have been made at correcting the weakness of the "throat" B♭ tone with mechanisms that switch from the speaker vent to a lower alternative tone hole for B♭. Most of these prior art solutions necessitated added mechanisms.

For example, U.S. Pat. No. 2,508,550 (Stubbins) teaches a speaker vent located at a node in the low register of a clarinet for producing upper register tones. A separate "resonance" hole is spaced circumferentially downstream from the register hole for producing, when opened with the speaker vent and the A key, a better B♭.

U.S. Pat. No. 2,951,414 (Christensen) teaches a mechanism associated with the register vent key by which an outlet of a size smaller than the conventional size of a register key may be opened to function exclusively when the tones A, A#, B and C just above the staff are produced, to sound these tones in correct pitch.

U.S. Pat. No. 706,557 (Heckel) teaches two separate holes on opposite sides of the clarinet at the approximate location of the normal vent, and added mechanisms for opening and closing the separate holes simultaneously U.S. Pat. No. 2,226,536 (Selmer) discloses a woodwind instrument, such as a clarinet, in which the speaker vent inside the clarinet is surrounded by a tubular cap or body, forming a resonant space opened freely toward the inside of the clarinet. The resonant space or chamber around the vent tube is said to provide for musical notes of enhanced timbre, purity and intensity.

U.S. Pat. No. 2,867,146 (Mazzeo) teaches the use of the lower side "B♭" hole with a mechanism that utilizes a different fingering from the usual clarinet fingering, and a cancellation mechanism which can revert to the standard clarinet fingering utilizing the prior vent B♭.

According to an aspect of the present invention, a speaker vent is provided having larger tube volume than hitherto provided, resulting in the sounding of a strong and better B♭. There is no added mechanism or change of fingering.

According to the preferred embodiment, the larger volume speaker vent incorporates an intermediate chamber in the middle of the vent tube to provide the required volume. This combined tube and chamber serve the dual purpose of speaker vent and throat B♭.

BRIEF DESCRIPTION OF THE DRAWINGS

Preferred embodiments of the present invention will be described in greater detail below with reference to the following drawings in which.

DETAILED DESCRIPTION OF THE PREFERRED EMBODIMENTS

Figure 1:
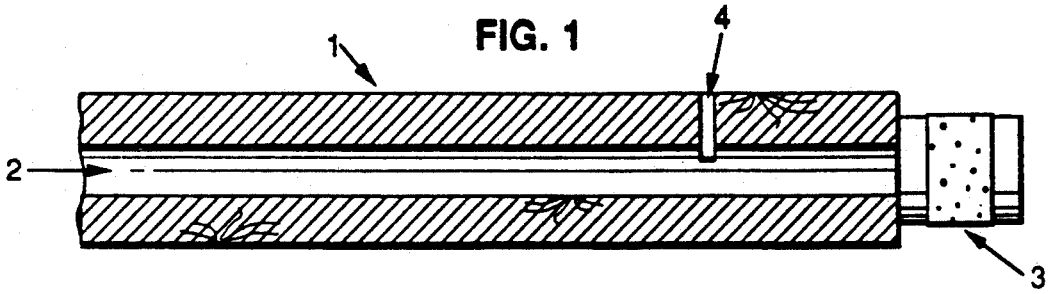
FIG. 1 is a partial cross sectional view of prior art clarinet with speaker vent 4.

Turning to FIG. 1, a cross-sectional view of a portion of a clarinet 1 is shown having a bore 2 and a stock 3 for connection to a further section of the clarinet. A speaker vent 4 is provided in the usual position and size, characterized by an internal volume in the order of 99 cubic millimeters.

Figure 2:
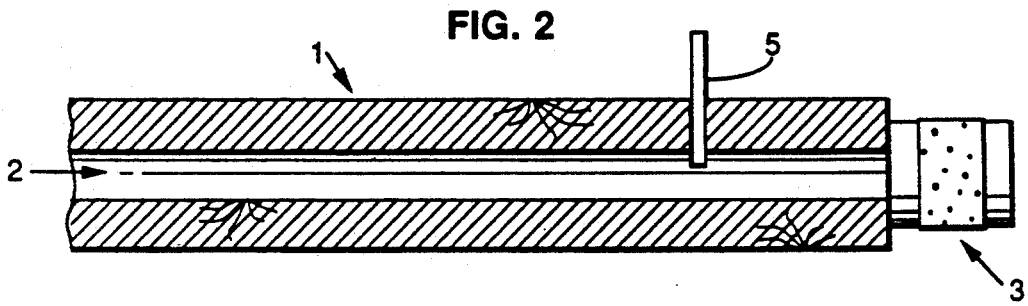
FIG. 2 is a cross sectional view of a clarinet illustrating a first embodiment of the speaker vent in accordance with the present invention.

In FIG. 2, the speaker vent 5 is shown more than twice as long as the prior art vent 4, and is characterized by an inside diameter that is larger, thereby providing an increased volume of air within the tube, resulting in a stronger B♭ tone than prior art clarinets. The vent 5 protrudes from the body of the clarinet in the illustrated embodiment.

Figure 3:
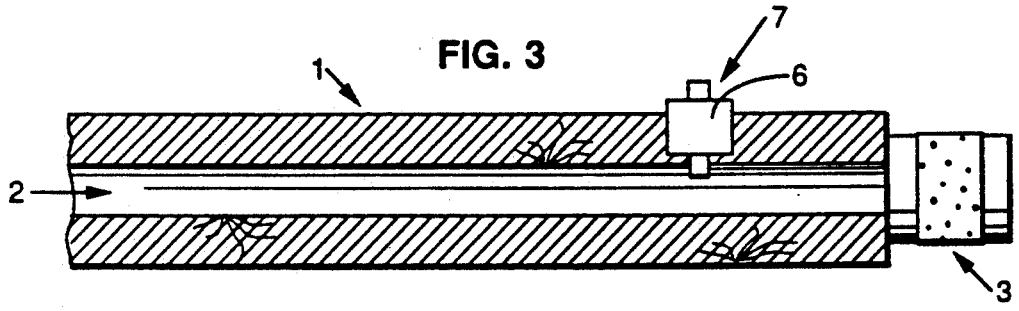
FIG. 3 is a cross sectional view illustrating a preferred embodiment of the speaker vent in accordance with the present invention.
Figure 4:
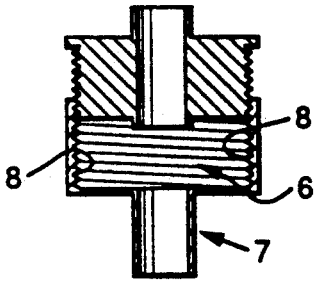
FIG. 4 is a close-up view of the speaker vent shown in FIG. 3.
Figure 5:
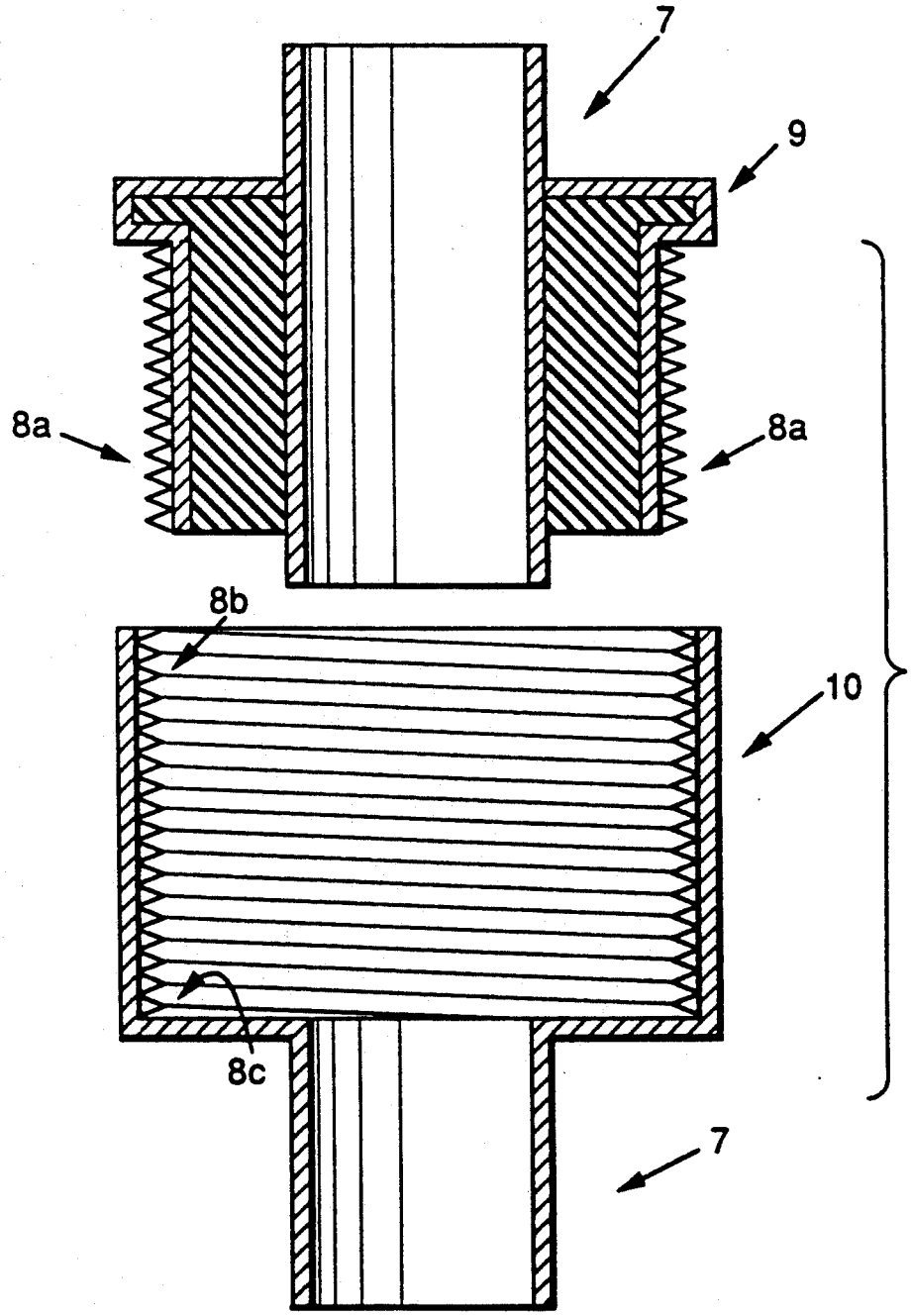
FIG. 5 is an exploded view of the speaker vent shown in FIGS. 3 and 4.

Turning to the preferred embodiment of FIGS. 3, 4 and 5, the length of the speaker vent 5 is reduced from the embodiment of FIG. 2 to a little more than the length of the conventional speaker vent 4 shown in FIG. 1. An intermediate chamber 6 is introduced in the tube 7 to compensate for the volume of the shortened portion tube as compared with the embodiment shown in FIG. 2. This shortened tube 7 and chamber 6 act both as the speaker vent and as a throat B♭ note. The inner chamber 6 functions to lower the pressure from inside the clarinet bore 2 to outside of the clarinet, thereby rendering smooth and unobstructed emission of the clarinet register.

Furthermore, in order to compensate for lost flow resistance by enlarging the tube at 6, impedance has been introduced by cutting threads 8 into the chamber 6, as shown in FIGS. 4 and 5. More particularly, upper and lower sections 9 and 10 of the vent 7, are connected together by means of cooperating outer threads 8*a* on top section 9 and inner threads 8*b* on bottom section 10, while inner threads 8*c* on bottom section 10 function to provide the necessary flow impedance.

Through experimentation, it has been discovered that the internal volume of the vent tubes in the embodiments of FIGS. 2–6 is in the vicinity of 200–285 $mm^3$ as compared to approximately 99 $m^3$ in the prior art.

Thus, in a successful prototype of the embodiment of FIG. 2, the tube 5 was characterized by a length of 26–28 mm and an inner diameter in the range of 3 mm to 4 mm. In a successful prototype of the preferred embodiment in FIGS. 3–5, the inner operative chamber 6 was characterized by a length in the range of 2–3 mm and inner diameter in the range of 7–9 mm, whereas the two sections of tube 7 on either side of chamber 6 were characterized by an inner diameter in the range of 2.8 mm to 3.8 mm and a combined length of in the range of 12 mm to 13 mm. The total length of the vent is 17–19 mm.

In summary, it has been found that the transition from the low register to the clarinet register is accomplished using the principle of the present invention, with much more ease than hitherto experienced. Transitions between notes have been found to be very smooth and the "clarinet" register rendered more The "throat" B♭ has been vastly improved and flexible. The "throat" B♭ has been vastly improved and strengthened over small tube vents of prior art clarinets. There is no added mechanisms or change of fingering.

Another embodiment of the invention is illustrated in FIGS. 6*a*–6*d*. The entire vent of the embodiment is between 17–19 mm long. The vent comprises a tube 11 that is between 12–13 mm long with an inside diameter of between 2.7–3.5 mm wide, leading to a chamber 12 that is between 5–7 mm long with an inside diameter of between 5–7 mm.

Figure 6A:
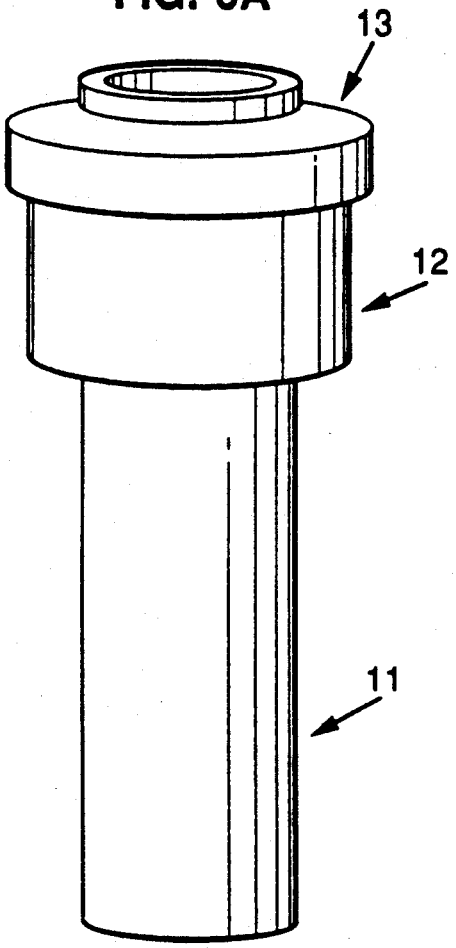
FIGS. 6*a* and 6*b* are perspective and cross sectional views of a speaker vent according to a first alternative embodiment of the invention.
Figure 6B:
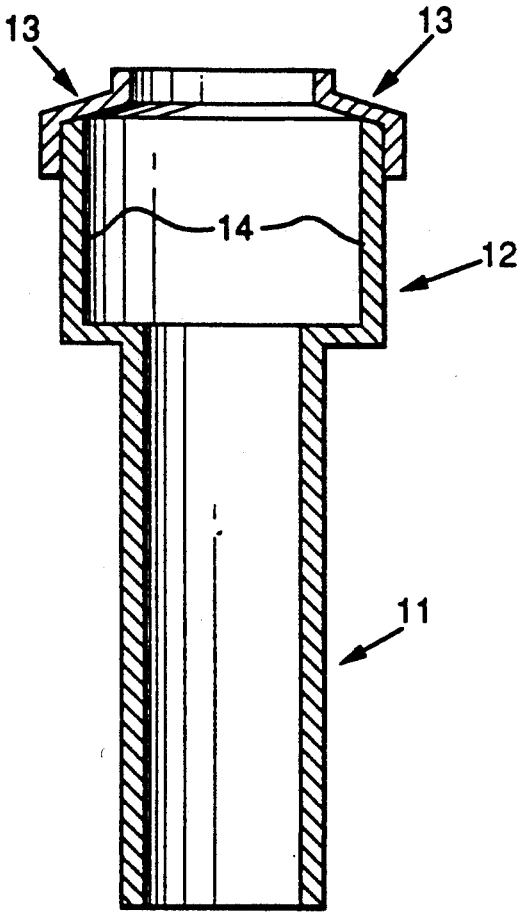
Figure 6C:
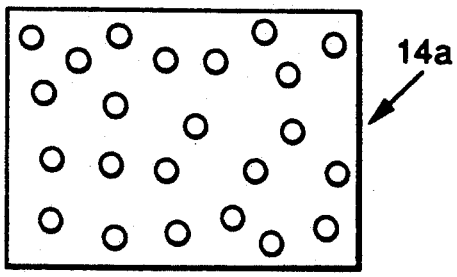
FIGS. 6*c* and 6*d* show alternative configurations of sleeve design for the embodiment of FIGS. 6*a* and 6*b*.
Figure 6D:
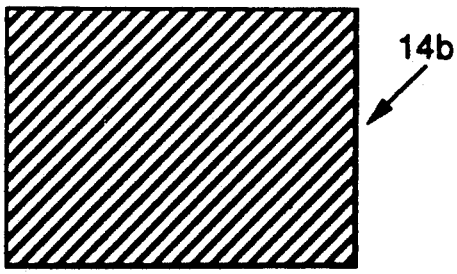

The inside of the chamber 12 is lined with a sleeve 14 that has perforations as in number 14*a* (FIG. 6*c*) or a sleeve that has grooves 14*b* as shown in FIG. 6*d*. The sleeve 14 can have other different topographic features such as indentations, threads or a combination of shapes. Each such shape or combination thereof offers a different tone quality.

The top of the chamber 12 is covered with a cap 13 that has an opening of between 3.5–5 mm in diameter. The cap may be screwed or soldered to the top of chamber 12.

Other embodiments or variations are possible within the sphere and scope of the present invention.

Figure 7:
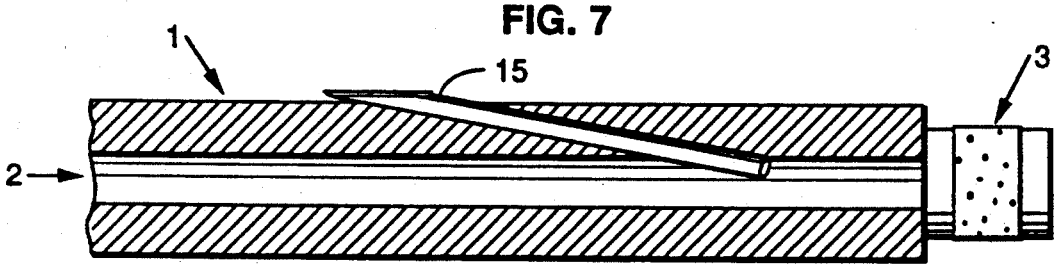
FIG. 7 is a cross sectional view of an oblique elongated vent/according to a second alternative embodiment.

For example, as an alternative to lengthening the vent tube outside the bore of the clarinet itself, one alternative comprises disposing the tube at an oblique angle 15, with the entrance in the bore 2 being located at the same place as prior art vents and the opening outside the clarinet being lower and closer to the "throat G" tone hole (see FIG. 7).

Furthermore, the principles of the present invention is equally applicable to the high register vent of a clarinet.

For example, the first finger hole for the left hand, the F-C hole, is used as a vent for the high register of the clarinet (i.e. the altissimo register).

When most notes in the high register are played, this tone hole is left open. The tone hole is of a small size and in a location which enables it to act as a high register vent.

There was an innovation by Adolphe Sax, in the last century, to improve this vent by covering the first finger hole with a perforated plate such that the plate would be closed and a smaller hole would be left open when the left hand first finger is raised. This principle is presently applied to bass clarinets and other such lower sounding clarinets.

U.S. Pat. No. 3,844,193 (Marchi) discloses a high register vent which is situated almost as high as the top of the barrel of the clarinet. The purpose of the Marchi vent is to create a new harmonic series starting from middle B (third line of the stave).

Figure 8:
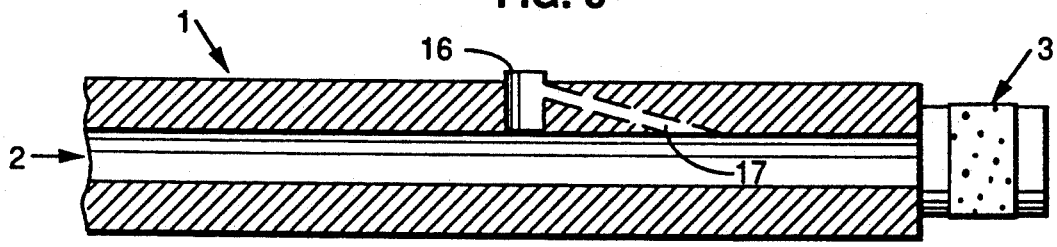
FIG. 8 is a cross sectional view of an oblique high register vent according to a third alternative embodiment.

The alternative embodiment of FIG. 8 is an improvement on the prior art high register vent (i.e. the hole 16 controlled by the first finger of the left hand). According to the illustrated embodiment, a further small hole 17 is drilled obliquely from inside the left hand first finger tone hole 16, towards the top of the instrument, opening into the bore 2, approximately opposite the location where the throat G tone hole is located.

When the first finger of the left hand is raised, this new oblique hole 17 allows the high notes to sound smoothly and, makes it easier to slur to and from the clarinet register to the higher altissimo notes.

Figure 9:
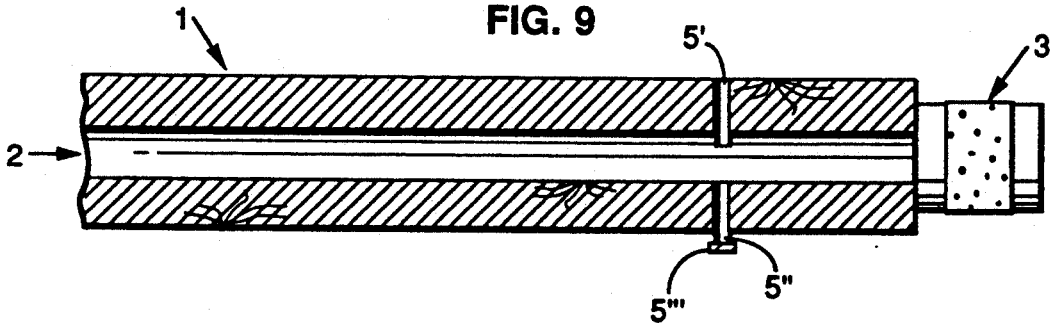
FIG. 9 is a cross-sectional view of a clarinet with speaker vent according to a fourth alternative embodiment.

With reference to FIG. 9, an alternative embodiment of the invention is shown which operates using a similar principle to the embodiment of FIG. 2. Specifically, a speaker vent is provided having two portions 5' and 5'' disposed on opposite sides of the bore 2 of the clarinet 1. The speaker vent portion 5' is open at both ends, whereas the speaker vent portion 5'' is open to the bore 2 but capped at 5''' on the outside of the clarinet stock. The combined volume of speaker vent portions 5' and 5'' is in the preferred range of from 200 $mm^3$ to 285 $mm^3$.

Finally, although the disclosed embodiments all relate to clarinet implementations of the invention, the principles of the invention are equally applicable to the entire clarinet, saxophone and oboe family (soprano, alto, bass, etc.), and are not limited to the clarinet embodiment disclosed herein.

All such embodiments or variations are believed to be within the sphere and scope of the claims appended hereto.

I claim:

1. In a woodwind instrument, the improvement comprising a speaker vent for providing a throat B♭, said vent extending from inside to the outside of the instrument, wherein said speaker vent is characterized by an internal volume in the range of from 200 $mm^3$ to 285 $mm^3$, and said speaker vent is in the form of a tube, a chamber located at one end of said tube, a sleeve within said chamber, said sleeve having a plurality of topographic features therein, a cap attached to said chamber on a side thereof opposite said tube, and an aperture in said cap.

2. The improvement of claim 1 wherein said tube has a length of between 12–13 mm and an internal diameter of between 2.7–3.5 mm.

3. The improvement of claim 1 wherein said chamber has a length of between 5–7 mm and an internal diameter of between 5–7 mm.

4. The improvement of claim 1 wherein said aperture is between 3.5–5 mm in diameter.

5. The improvement of claim 1 wherein said topographic features are circular perforations.

6. The improvement of claim 1 wherein said topographic features are oblique threads.

7. In a woodwind instrument, the improvement comprising a speaker vent for providing a throat B♭, said vent extending from inside to the outside of the instrument, wherein said speaker vent is characterized by an internal volume in the range of from 200 $mm^3$ to 285 $mm^3$, wherein said speaker vent is in the form of a tube having an internal diameter in the range of from 3 m to 4 mm and a length of approximately 26–28 mm, and wherein said tube comprises a first portion being open at both ends and extending from the outside of the instrument to the inside thereof and a second portion being open at one end on the inside of the instrument opposite said first portion and closed at a remote end on the outside of the instrument.

* * * * *